US006789708B2

(12) United States Patent
Hansen

(10) Patent No.: US 6,789,708 B2
(45) Date of Patent: Sep. 14, 2004

(54) COMBINATION PUSH BUTTON AND BOTTLE LEVER FOR ACTIVATING A WATER VALVE IN A PRODUCT DISPENSER

(75) Inventor: Jeremy J. Hansen, South St. Paul, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 10/266,094

(22) Filed: Oct. 4, 2002

(65) Prior Publication Data

US 2004/0065673 A1 Apr. 8, 2004

(51) Int. Cl.[7] ..... B67D 3/00

(52) U.S. Cl. ..... 222/505; 222/518; 222/181.3; 141/18; 141/360; 141/362

(58) Field of Search ..... 222/505, 518, 222/181.3, 145.1, 132, 1; 141/360, 361, 362, 9, 18, 383, 2

(56) References Cited

U.S. PATENT DOCUMENTS 3,438,551 A 4/1969 Belisle
4,685,596 A 8/1987 Mattheis
5,584,327 A * 12/1996 Thomas et al. ..... 141/104
5,597,019 A * 1/1997 Thomas et al. ..... 141/18
5,651,398 A * 7/1997 Decker et al. ..... 141/18
5,832,972 A 11/1998 Thomas et al. ..... 141/360
6,105,633 A * 8/2000 Pedersen et al. ..... 141/18
6,279,836 B1 8/2001 Toetschinger et al.
6,439,272 B1 * 8/2002 Wertheim ..... 141/2

FOREIGN PATENT DOCUMENTS

CH 677 092 A5 4/1991

OTHER PUBLICATIONS

Ecolab Inc., Oasis Select 4 Installation & Operation Manual, 2001.

* cited by examiner

*Primary Examiner*—Gene Mancene
*Assistant Examiner*—Frederick Nicolas
(74) *Attorney, Agent, or Firm*—IPLM Group, P.A.

(57) ABSTRACT

A dispenser (100) for diluting and dispensing a product concentrate into a container includes an actuation switch (108) and an actuator (115). The actuation switch (108) may either be manually activated in a first direction or it may be activated by pushing a container against the actuator (115) in a second direction which in turn pushes the actuation switch in the first direction to dispense a use solution. Therefore, the dispenser (100) readily accommodates any type of container.

18 Claims, 4 Drawing Sheets

FIG.4A
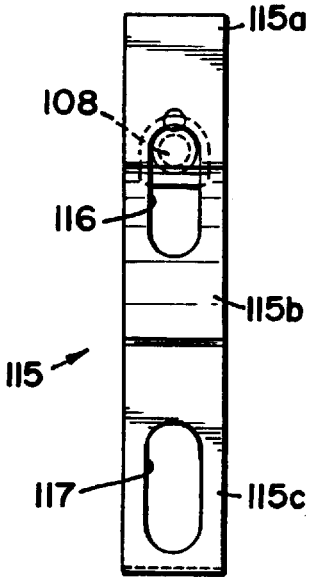
FIG.4B
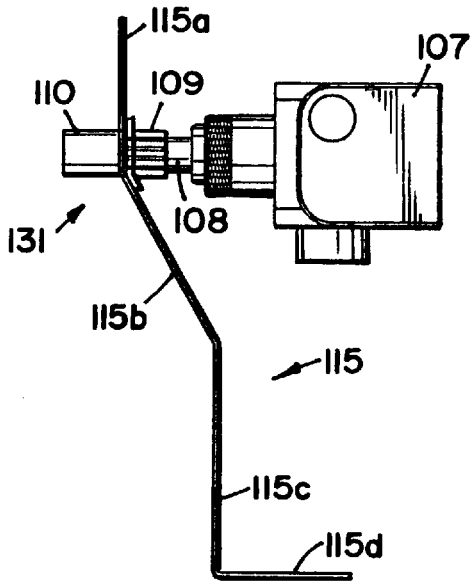
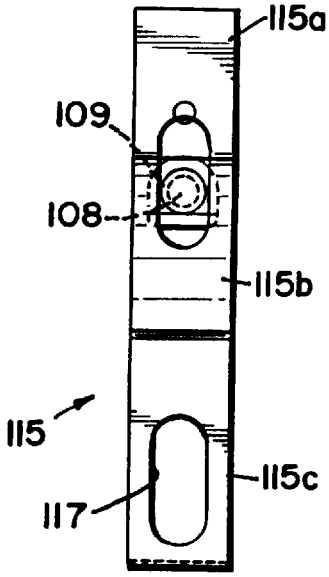
FIG.5A
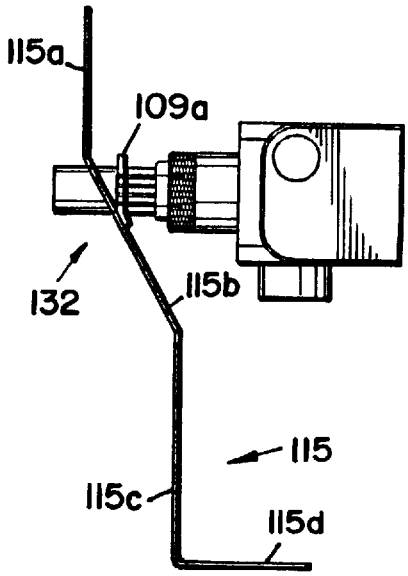
FIG.5B

COMBINATION PUSH BUTTON AND BOTTLE LEVER FOR ACTIVATING A WATER VALVE IN A PRODUCT DISPENSER

BACKGROUND OF THE INVENTION

1. Field of the Invention

The present invention relates to a product dispenser having a combination push button and bottle lever for activating a water valve in the product dispenser to dispense the product.

2. Description of the Prior Art

Product dispensers including an aspirator to dilute a concentrate with a diluent to form a use solution, which is dispensed from the dispenser, are well known. A typical prior art dilution dispenser includes a product concentrate reservoir, a diluent source, and an aspirator. A container, such as a bottle or a bucket, receives the use solution dispensed from the dispenser. The diluent (e.g. water) is passed through the aspirator, and a venturi in the aspirator draws the concentrate into contact with the diluent and mixes them together to create the use solution. Many configurations of these components are possible.

A hose or conduit may be operatively connected to the dispensing end of the aspirator to carry the use solution to the desired container. When activating the dispenser, it is often necessary to place the hose or conduit in the container and then manually activate a push button on the dispenser. Alternatively, some dispensers include a push button that is activated by pressing a bottle against a lever proximate the dispensing end of the aspirator. However, these types of dispenser do not readily accommodate both bottles and buckets.

SUMMARY OF THE INVENTION

In a preferred embodiment actuator for use with a dispenser for dispensing a product concentrate into a container, the dispenser includes an aspirator, a valve, and an activation switch. The aspirator has a liquid diluent inlet, a product concentrate inlet, and a use solution outlet. The valve is operatively connected to the aspirator, and the valve controls flow of liquid diluent from a liquid diluent source to the liquid diluent inlet. The activation switch has an end portion and is operatively connected to the valve. The activation switch controls the valve. The actuator includes a first end, an extension portion, an angled portion, and a second end. The angled portion interconnects the first end and the extension portion, and the second end is operatively connected to and extends from the extension portion. The second end is configured and arranged to be contacted by the container. A slot extends from the first end to the angled portion, and the end portion of the activation switch extends through the slot, wherein the slot does not interfere with the end portion. The actuator has a first position wherein the activation switch is in a first state and a second position wherein the angled portion contacts the activation switch and moves the activation switch to a second state. The slot does not interfere with the end portion of the activation switch.

In a preferred embodiment dispenser for dispensing a product concentrate, an aspirator has a liquid diluent inlet, a product concentrate inlet, and a use solution outlet. A valve is operatively connected to the aspirator, and the valve controls flow of liquid diluent from a liquid diluent source to the liquid diluent inlet. An activation switch is operatively connected to the valve, and the activation switch controls the valve. An actuator has a first end, a second end, an intermediate portion, and a slot. The first end is proximate the activation switch, the intermediate portion interconnects the first end and the second end, and the slot extends from the first end to the intermediate portion and allows access to the activation switch without interfering with the activation switch. The activation switch is activated by one of two ways. The first way is by moving the actuator in a first direction with a container thereby moving the activation switch in a second direction, and the second way is by moving the activation switch in the second direction.

In a preferred embodiment apparatus for diluting a liquid concentrate with a liquid diluent to form a dilute use solution for dispensing the dilute use solution into a container, an aspirator has a liquid diluent inlet, a product concentrate inlet, and a use solution outlet. A valve is operatively connected to the aspirator, and the valve controls flow of liquid diluent from a liquid diluent source to the liquid diluent inlet. An activation switch is operatively connected to the valve, and the activation switch controls the valve. An actuator has a first end and a second end. The first end has an aperture through which the activation switch extends and the second end is proximate the use solution outlet, wherein movement of the actuator in a first direction presses the activation switch in a second direction to create the dilute use solution, and wherein movement of the activation switch in the second direction creates the dilute use solution.

In a preferred embodiment dispensing system for supplying a plurality of use solutions, a dispenser has an aspirator, a valve, and an activation switch. The aspirator includes a liquid diluent inlet, a product concentrate inlet, and a use solution outlet. The valve is operatively connected to the aspirator, and the valve controls flow of liquid diluent from a liquid diluent source to the liquid diluent inlet. The activation switch is operatively connected to the valve, and the activation switch controls the valve. An actuator has a first end, a second end, an intermediate portion, and a slot. The first end is proximate the activation switch, the intermediate portion interconnects the first end and the second end, and the slot extends from the first end to the intermediate portion. The activation switch extends through the slot and the slot does not interfere with the activation switch. The activation switch is activated one of two following ways. The first way is by moving the actuator in a first direction with a container thereby moving the activation switch in a second direction, and the second way is by moving the activation switch in the second direction. A conduit is operatively connected to the use solution outlet, and a container is configured and arranged to receive the conduit and to contain one of the plurality of use solutions.

In a preferred embodiment method of dispensing a use solution into a container from a dispenser, the dispenser has an aspirator, a conduit, a valve, an activation switch, and an actuator. The aspirator has a liquid diluent inlet, a product concentrate inlet, and a use solution outlet. The conduit is in fluid communication with the use solution outlet. The valve is operatively connected to the aspirator to control flow of liquid diluent from a liquid diluent source into the liquid diluent inlet. The activation switch is operatively connected to the valve, and the activation switch activates the valve. The actuator is configured and arranged to activate the activation switch thereby activating the valve, and the activation switch extends through the actuator. The conduit is inserted into the container. The activation switch is activated by one of two following ways. The first way is by moving the actuator in a first direction with a container thereby moving the activation switch in a second direction, and the second way is by moving the activation switch in the second direction. The use solution is then dispensed into the container.

In a preferred embodiment method of dispensing a use solution into a container from a dispenser, the dispenser has an aspirator, a conduit, a valve, an activation switch, and a actuator. The aspirator has a liquid diluent inlet, a product concentrate inlet, and a use solution outlet. The conduit is in fluid communication with the use solution outlet and has a longitudinal axis. The valve is operatively connected to the aspirator to control flow of liquid diluent from a liquid diluent source into the liquid diluent inlet. The activation switch is operatively connected to the valve, and the activation switch activates the valve. The actuator is configured and arranged to activate the activation switch thereby activating the valve. A bottle is placed under the dispenser, and the conduit is inserted into the bottle. The bottle is moved along a line substantially parallel to the longitudinal axis of the outlet conduit to activate dispensing of the use solution. The bottle is removed from under the dispenser. A bucket is placed proximate the dispenser, and the conduit is inserted into the bucket. The activation switch is pressed to activate dispensing of the use solution.

In a preferred embodiment method of dispensing a use solution into a container from a dispenser, an activation switch is provided, and the activation switch activates a valve, which controls an aspirator. An actuator having a first end, a second end, an intermediate portion, and a slot is provided. The first end is proximate the activation switch, the intermediate portion interconnects the first end and the second end, and the slot extends from the first end to the intermediate portion. The slot allows access to the activation switch and does not interfere with the activation switch. The activation switch is activated in one of two following ways. The first way is by moving the actuator in a first direction with a container thereby moving the activation switch in a second direction, and the second way is by moving the activation switch in the second direction.

BRIEF DESCRIPTION OF THE DRAWINGS

FIG. 4*a* is a front view of a push button of the dispenser shown in FIG. 1 not activated;

FIG. 4*b* is a side view of a push button and a bottle lever of the dispenser shown in FIG. 1 not activated;

FIG. 5*a* is a front view of a push button of the dispenser shown in FIG. 1 activated to dispense product; and FIG. 5*b* is a side view of a push button and a bottle lever of the dispenser shown in FIG. 1 activated to dispense product.

DETAILED DESCRIPTION OF A PREFERRED EMBODIMENT

Figure 1:
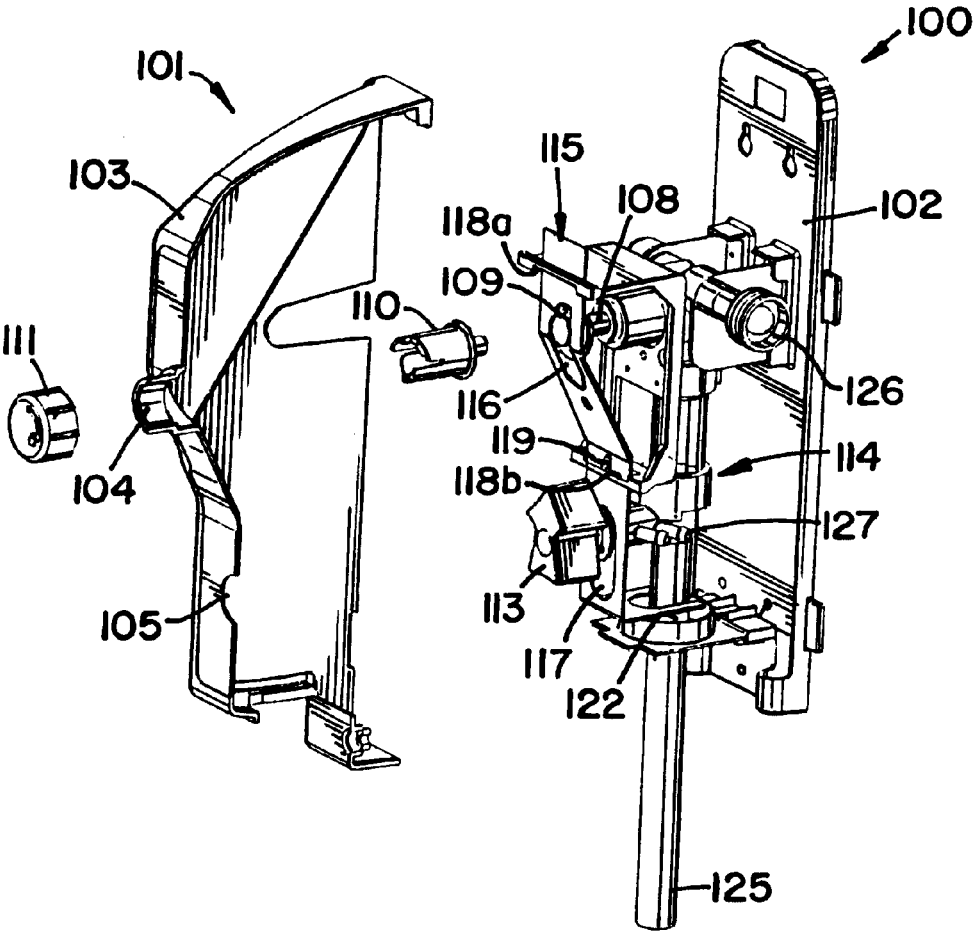
FIG. 1 is a partially exploded perspective view of a dispenser constructed according to the principles of the present invention.

A dispenser constructed according to the principles of the present invention is designated by the numeral 100 in the drawings.

The dispenser 100 is a dispenser for filling both spray bottles and mop buckets or other suitable containers well known in the art with a diluted product. The present invention is a modification of the dispenser disclosed in U.S. Pat. No. 5,832,972 by Thomas et al., which is incorporated by reference herein. The present invention modifies the slide actuator by adding a slot through which the activation switch extends. Therefore, the activation switch may be activated in two different ways. One way is to simply manually press the push button operatively connected to the activation switch. The second way is to use a spray bottle to press the member or bottle lever in an upward direction thereby sliding the actuator upward to press the activation switch. The activation switch activates the water valve of the dispenser to fill the container. Although the present invention incorporates the dispenser disclosed in U.S. Pat. No. 5,832,972 by reference, a more detailed description of the present invention follows.

As shown in FIG. 1, the dispenser 100 includes a housing 101, which has a base 102 and a cover 103. The base 102 provides a mounting surface for mounting the dispenser 100 to a surface such as a wall and for operatively connecting other components of the dispenser 100. The cover 103 is configured and arranged to engage the base 102 and to cover the other components. The cover 103 includes an opening 104 and an opening 105.

The housing 101 houses a valve 107, which is activated by an activation switch 108. A slide or guide member 109 is operatively connected to the activation switch 108 and an extender 110 is operatively connected to the guide member 109. The guide member 109 includes a flange member 109*a*. The extender 110 extends through opening 104 in the cover 103. A knob 111 is operatively connected to the extender 110 and provides a push button to activate the activation switch 108 when pressed. The knob 111 allows for manual activation of the activation switch 108. Although the preferred embodiment shows the activation switch 108, the guide member 109, the extender 110, and the knob 111 as separate pieces, it is recognized that these components could be one piece or several pieces. The single component activation switch has an end portion extending through the opening 104.

Figure 2:
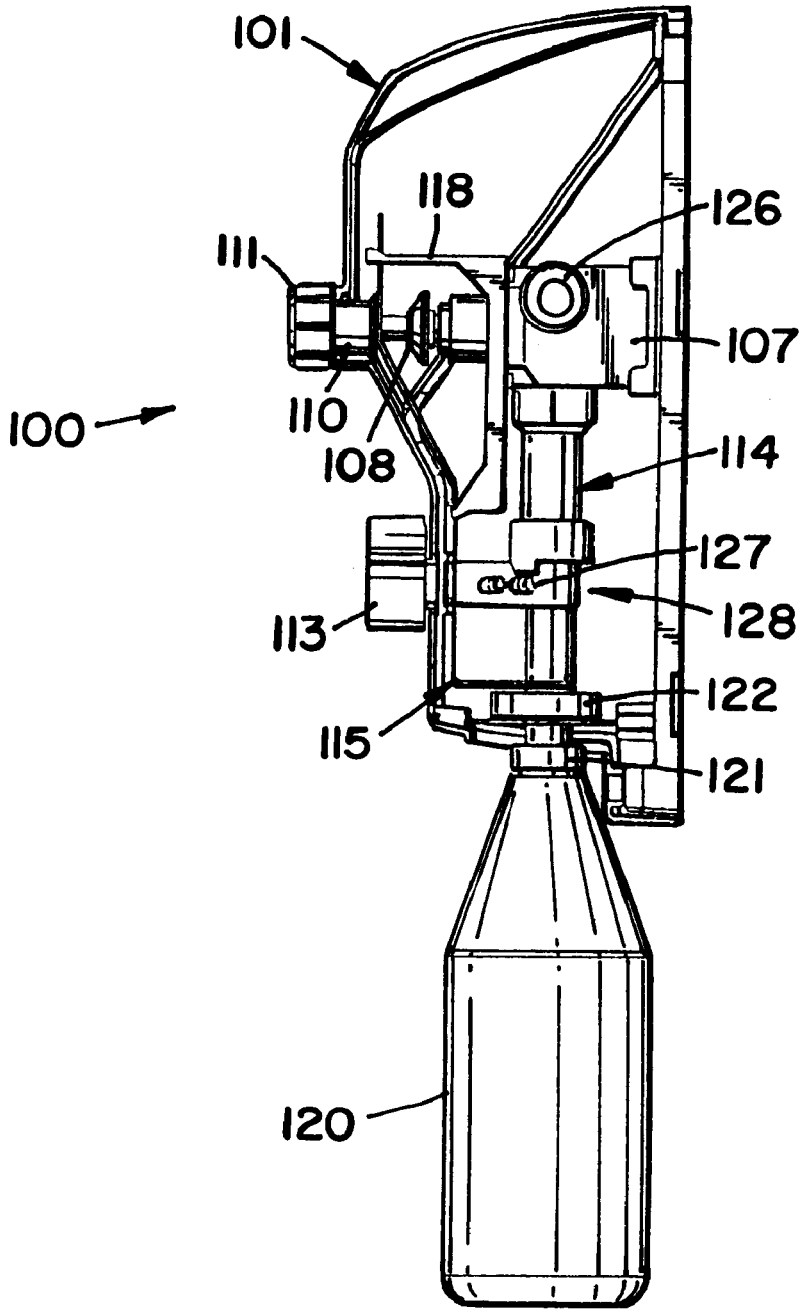
FIG. 2 is a side view of the dispenser shown in FIG. 1 not activated.
Figure 3:
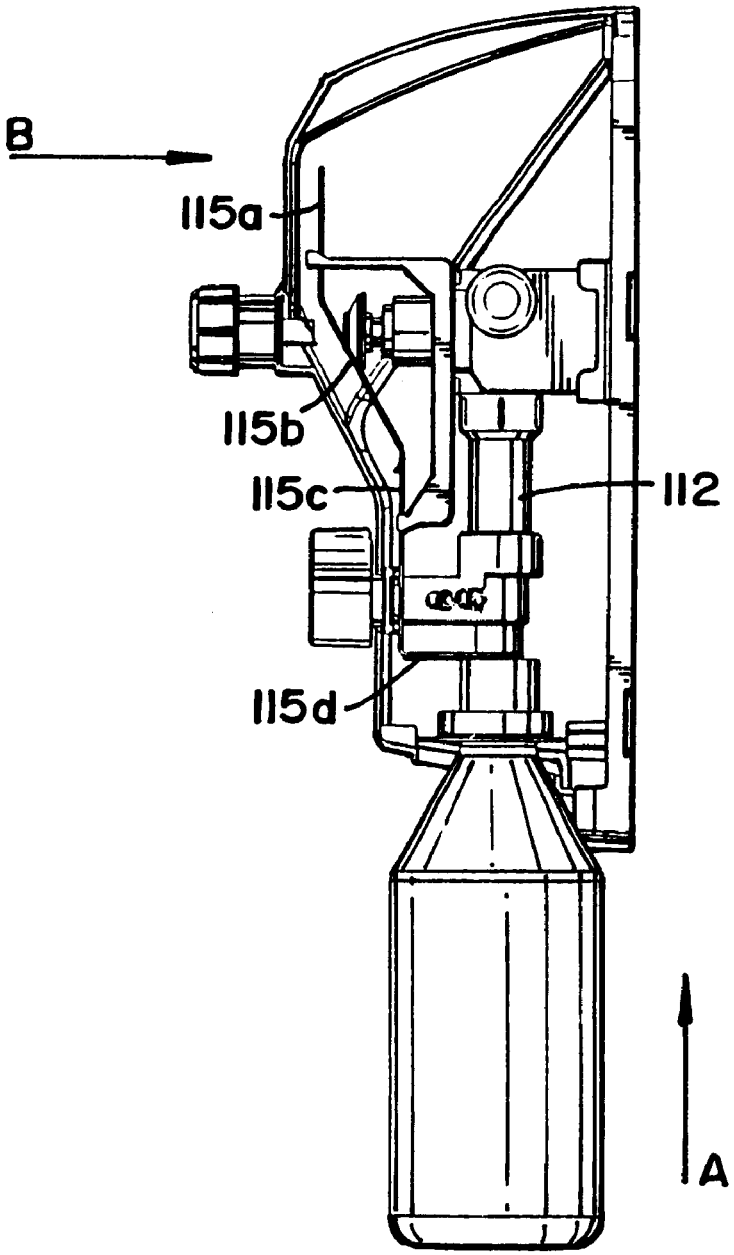
FIG. 3 is a side view of the dispenser shown in FIG. 1 activated to dispense product.

The valve 107 controls the diluent input into an aspirator 114. The aspirator 114 includes a venturi driven by water pressure to draw in the product concentrate as the diluent flows through the aspirator 114. The aspirator 114 includes a diluent inlet 126, a product concentrate inlet 127, and a use solution outlet 128. As shown in FIGS. 1–3, there are two product concentrate inlets 127 on each side, two of which are not shown. This allows four different product concentrates to be utilized with the dispenser 100. A use solution outlet conduit 125 is operatively connected to the use solution outlet 128. The velocity of the diluent through the diluent inlet 126 and the venturi causes a reduction in pressure, draws the product concentrate into the aspirator 114 through the product concentrate inlet 127, generally causing a mixing of the product concentrate and diluent. Once the product concentrate and the diluent are mixed, a use solution is formed, which exits the aspirator 114 through the use solution outlet 128 and the use solution outlet conduit 125.

An air gap 112 should also be used to conform with plumbing code requirements, and the present invention utilizes an aspirator including an air gap such as a Flex-Gap™ aspirator manufactured by Knight, INC. of Lake Forest, Calif. The air gap 112 should be used to separate the outlet of the potable water supply from any potential contamination to ensure reliable back-flow protection. An Air Gap Proportioner, 4 gpm, number 10070400, manufactured by Hydro Systems Company of Cincinnati, Ohio could also be used. Typically a 1 gpm aspirator is used to fill bottles and a 4 gpm aspirator is used to fill mop buckets. The preferred embodiment utilizes a 1 gpm aspirator to readily accommodate both bottles and buckets along with other suitable containers. However, it is recognized that any size aspirator may be used with the dispenser to correspond with the desired use of the dispenser. A suitable aspirator may even be swapped with an existing aspirator to accommodate different uses of the dispenser, and the dispenser may be retrofitted for such different uses.

In the preferred embodiment, water is used as the diluent. A water supply is connected to the diluent inlet 126 and a concentrated product is connected to the product concentrate inlet 127. The preferred embodiment utilizes a liquid product concentrate, however, it is understood that solid product concentrates could also be utilized with appropriate dilution apparatus and methods well known in the art. Generally, the product concentrate could be general purpose cleaning and sanitizing compositions and other useful institutional or industrial liquid concentrate compositions such as window cleaners, hand soap, surface cleaners, disinfectants, floor finishes, and air fresheners. However, this list is for illustrative purposes only and is not exhaustive.

A product selector 113 extends through the opening 105 in the cover 103, and the product selector 113 rotates to select which of the four products is to be dispensed. The product selector 113 activates the desired product concentrate inlet 127.

A slide actuator 115 is a thin, elongate member including a first end 115*a*, an angled portion 115*b*, an extension portion 115*c*, and a second end 115*d*. An intermediate portion includes the angled portion 115*b* and the extension portion 115*c*. The preferred embodiment slide actuator 115 is made of metal, but any suitable material known in the art may be used. The first end 115*a* extends generally in an upward direction proximate the top of the dispenser, and the extension portion 115*c* also extends generally in an upward direction, parallel to the first end 115*a* and proximate the bottom of the dispenser. The angled portion 115*b* slants from the first end 115*a* toward the extension portion 115*c* and interconnects these two portions. The second end 115*d* extends generally horizontally from the extension portion 115*c* at approximately a 90° angle. It is also possible for the intermediate portion to be one portion and interconnect the first end 115*a* and the second end 115*d* at an angle.

The first end 115*a* and the angled portion 115*b* include a first slot 116 extending proximate the middle of the first end 115*a* to proximate the middle of the angled portion 115*b*. The guide member 109 extends through the first slot 116 and the first slot 116 does not interfere with the guide member 109 as the slide actuator 115 moves upward and downward. Alternatively, should the guide member 109 not extend though the first slot 116, the first slot 116 allows access to the activation switch 108 in the second, lateral direction B. The extension portion 115*c* includes a second slot 117 through which the product selector 113 extends, and the second slot 117 does not interfere with the operation of the product selector 113 as the slide actuator 115 moves upward and downward.

A U-shaped bracket 118 including two slits 118*a* and 118*b*, one at each end, is operatively connected to the dispenser 100 proximate the activation switch 108. Each of the slits 118*a* and 118*b* is configured and arranged to position the slide actuator 115 without interfering with the upward and downward movement of the actuator 115. The first end 115*a* fits within the first slit 118*a* and the extension portion 115*c* fits within the second slit 118*b*. On the extension portion 115*c* proximate the juncture of the angled portion 115*b* and the extension portion 115*c* is a tab 119. The tab 119 extends outward from the actuator 115 and acts as a stop member to prevent the actuator 115 from sliding through the slit 118*b*. However, tab 119 is optional.

A bottle 120 includes a neck 121, and a receiving aperture 122 configured and arranged to accept the neck 121 of the bottle 120. The receiving aperture 122 surrounds the conduit 125. When the conduit 125 is placed within the bottle 120, the neck 121 fits within the receiving aperture 122 to activate the actuator 115 thereby dispensing use solution into the bottle 120.

As shown in FIGS. 4*a* and 4*b*, the actuator 115 is in a first position 131 wherein the actuator 115 is not activating the activation switch 108 and the activation switch 108 is in a first state. As shown in FIGS. 5*a* and 5*b*, the actuator is in a second position 132 wherein the actuator 115 is activating the activation switch 108 and the activation switch 108 is in a second state. Although these figures show the first end 115*a* contacting the guide member 109, contact is not necessary between these components.

In operation, the dispenser 100 includes both button-activated and bottle-activated dispensing options that automatically dilute and dispense cleaning and sanitizing solutions mixed to the correct ratios. When button-activation is utilized, the water valve 107 is activated by the activation switch 108 which is activated when the knob 111 is manually pressed in a lateral direction. When the knob 111 is pressed, the valve 107 allows water to flow through the venturi in the aspirator 114 and the aspirator 114 then concurrently draws in a concentrated product. The water mixes with the concentrated product within the aspirator 114 to the correct ratio to form a use solution. The use solution is then dispensed through the use solution outlet 128 and the conduit 125 into a container such as a mop bucket.

When bottle-activation is utilized, the conduit 125 is placed inside the bottle 120 and the bottle neck 121 is inserted into the receiving aperture 122. This is shown in FIG. 2. The bottle 120 is then moved in a first, upward direction A to contact the second end 115*d* of the slide actuator 115. As the bottle 120 is moved further in the first direction A, the bottle 120 pushes against the second end 115*d* and moves the slide actuator 115 upward. As the slide actuator 115 moves upward with the bottle 120, the guide member 109 remains stationary and slides within the slot 116 along the angled portion 115*b*. The flange member 109*a* of the guide member 109 contacts the angled portion 115*b*. The angled portion 115*b* pushes against the flange member 109*a* and as the slide actuator 115 moves upward the guide member 109 is pressed inward in the second, lateral direction B thereby activating the activation switch 108. In other words, the angled portion 115*b* pushes the activation switch 108 in a second, lateral direction B, and the activation switch 108 in turn activates the valve 107. This is shown in FIG. 3. Although the guide member 109 extends through the slot 116, the slot 116 does not interfere with the guide member 109 as the actuator 115 moves upward and downward.

The above specification, examples and data provide a complete description of the manufacture and use of the composition of the invention. Since many embodiments of the invention can be made without departing from the spirit and scope of the invention, the invention resides in the claims hereinafter appended.

I claim:

1. An actuator for use with a dispenser for dispensing a product concentrate into a container, the dispenser including an aspirator having a liquid diluent inlet, a product concentrate inlet, and a use solution outlet, a valve operatively connected to the aspirator, the valve controlling flow of liquid diluent from a liquid diluent source to the liquid diluent inlet, and an activation switch having an end portion and being operatively connected to the valve, the activation switch controlling the valve, comprising:

a) a first end;

b) an extension portion;

c) an angled portion interconnecting the first end and the extension portion;

d) a second end operatively connected to and extending from the extension portion, the second end being configured and arranged to be contacted by the container;

e) a slot extending from the first end to the angled portion, the end portion of the activation switch extending through the slot, wherein the slot does not interfere with the end portion;

f) a first position wherein the activation switch is in a first state; and g) a second position wherein the angled portion contacts the activation switch and moves the activation switch to a second state, and the slot does not interfere with the end portion of the activation switch.

2. The actuator of claim 1, the activation switch including a guide member extending through the slot, wherein the slot does not interfere with the guide member when movement between the first position and the second position occurs.

3. The actuator of claim 2, wherein the guide member moves along the angled portion, the angled portion pressing the activation switch thereby activating the valve.

4. A dispenser for dispensing a product concentrate, comprising:

a) an aspirator having a liquid diluent inlet, a product concentrate inlet, and a use solution outlet;

b) a valve operatively connected to the aspirator, the valve controlling flow of liquid diluent from a liquid diluent source to the liquid diluent inlet;

c) an activation switch operatively connected to the valve, the activation switch controlling the valve; and d) an actuator having a first end, a second end, an intermediate portion, and a slot, the first end being proximate the activation switch, the intermediate portion interconnecting the first end and the second end, the slot extending from the first end to the intermediate portion and allowing access to the activation switch without interfering with the activation switch, wherein the activation switch is activated one of two following ways:

i) moving the actuator in a first direction with a container thereby moving the activation switch in a second direction; and ii) moving the activation switch in the second direction.

5. The dispenser of claim 4, wherein the intermediate portion presses the activation switch thereby activating the valve when movement of the actuator in the first direction occurs.

6. The dispenser of claim 5, wherein the intermediate portion includes an angled portion and an extension portion, the angled portion being operatively connected to the first end and the extension portion being operatively connected to the second end.

7. The dispenser of claim 6, wherein the slot extends from the first end to the angled portion, the angled portion providing a surface upon which the activation switch is pressed thereby activating the valve.

8. An apparatus for diluting a liquid concentrate with a liquid diluent to form a dilute use solution for dispersing the dilute use solution into a container, comprising:

a) an aspirator having a liquid diluent inlet, a product concentrate inlet, and a use solution outlet;

b) a valve operatively connected to the aspirator, the valve controlling flow of liquid diluent from a liquid diluent source to the liquid diluent inlet;

c) an activation switch operatively connected to the valve, the activation switch controlling the valve; and d) an actuator having a first end and a second end, the first end having an aperture through which the activation switch extends and the second end being proximate the use solution outlet, wherein movement of the actuator in a first direction presses the activation switch in a second direction to create the dilute use solution, and wherein movement of the activation switch in the second direction creates the dilute use solution.

9. The apparatus of claim 8, wherein the activation switch is manually activated.

10. The apparatus of claim 8, wherein the actuator is activated with a container.

11. A dispensing system for supplying a plurality of use solutions, comprising:

a) a dispenser having an aspirator including a liquid diluent inlet, a product concentrate inlet, and a use solution outlet, a valve operatively connected to the aspirator, the valve controlling flow of liquid diluent from a liquid diluent source to the liquid diluent inlet, and an activation switch operatively connected to the valve, the activation switch controlling the valve;

b) an actuator having a first end, a second end, an intermediate portion, and a slot, the first end being proximate the activation switch, the intermediate portion interconnecting the first end and the second end, the slot extending from the first end to the intermediate portion, the activation switch extending through the slot and the slot not interfering with the activation switch, wherein the activation switch is activated one of two following ways:

i) moving the actuator in a first direction with a container thereby moving the activation switch in a second direction; and ii) moving the activation switch in the second direction;

c) a conduit operatively connected to the use solution outlet; and d) a container configured and arranged to receive the conduit and to contain one of the plurality of use solutions.

12. The dispensing system of claim 11, wherein said container is a bottle.

13. The dispensing system of claim 11, wherein said container is a bucket.

14. A method of dispensing a use solution into a container from a dispenser having an aspirator with a liquid diluent inlet, a product concentrate inlet, and a use solution outlet, a conduit in fluid communication with the use solution outlet, a valve operatively connected to the aspirator to control flow of liquid diluent from a liquid diluent source into the liquid diluent inlet, an activation switch operatively connected to the valve, wherein the activation switch activates the valve, an actuator configured and arranged to activate the activation switch thereby activating the valve, the activation switch extending through the actuator, comprising:

a) inserting the conduit into the container;

b) activating the activation switch by one of two following ways:

i) moving the actuator in a first direction with a container thereby moving the activation switch in a second direction; and ii) moving the activation switch in the second direction; and c) dispensing the use solution into the container.

15. A method of dispensing a use solution into a container from a dispenser having an aspirator with a liquid diluent inlet, a product concentrate inlet, and a use solution outlet, a conduit in fluid communication with the use solution outlet having a longitudinal axis, a valve operatively connected to the aspirator to control flow of liquid diluent from a liquid diluent source into the liquid diluent inlet, an activation switch operatively connected to the valve, wherein the activation switch activates the valve, an actuator configured and arranged to activate the activation switch thereby activating the valve, comprising:

a) placing a bottle under the dispenser;

b) inserting the conduit into the bottle;

c) moving the bottle along a line substantially parallel to the longitudinal axis of the outlet conduit to activate dispensing of the use solution;

d) removing the bottle from under the dispenser;

e) placing a bucket proximate the dispenser;

f) inserting the conduit into the bucket; and g) pressing the activation switch to activate dispensing of the use solution the activation switch extending beyond the actuator.

16. A method of dispensing a use solution into a container from a dispenser, comprising:

a) providing an activation switch, the activation switch activating a valve, the valve controlling an aspirator;

b) providing an actuator having a first end, a second end, an intermediate portion, and a slot, the first end being proximate the activation switch, the intermediate portion interconnecting the first end and the second end, the slot extending from the first end to the intermediate portion, the slot allowing access to the activation switch and not interfering with the activation switch; and c) activating the activation switch in one of two following ways:

i) moving the actuator in a first direction with a container thereby moving the activation switch in a second direction; and ii) moving the activation switch in the second direction.

17. The method of claim 16, wherein the activation switch is manually activated.

18. The method of claim 16, wherein the actuator is activated with the container.

* * * * *